US005735737A

United States Patent [19]

Fridolfsson

[11] Patent Number: 5,735,737

[45] Date of Patent: Apr. 7, 1998

[54] ELECTRIC CURRENT CARRYING CONDUIT MOUNTED ON SEALING STRIP AT EXHAUSTING DEVICES

[75] Inventor: Olof Nils Fridolfsson, Helsingborg, Sweden

[73] Assignee: AB Ph. Nederman & Co., Helsingborg, Sweden

[21] Appl. No.: 732,211

[22] PCT Filed: Apr. 27, 1995

[86] PCT No.: PCT/SE95/00463

§ 371 Date: Oct. 24, 1996

§ 102(e) Date: Oct. 24, 1996

[87] PCT Pub. No.: WO95/29771

PCT Pub. Date: Nov. 9, 1995

[30] Foreign Application Priority Data

Apr. 29, 1994 [SE] Sweden ..... 9401469

[51] Int. Cl.[6] ..... F23J 11/02

[52] U.S. Cl. ..... 454/64

[58] Field of Search ..... 454/64, 166, 167

[56] References Cited

U.S. PATENT DOCUMENTS

| | | | |
|---|---|---|---|
| 3,855,941 | 12/1974 | Fromme et al. | 105/150 |
| 4,233,889 | 11/1980 | Nederman | 454/64 |
| 4,660,465 | 4/1987 | Jentzsch et al. | 454/64 |
| 4,724,751 | 2/1988 | Jentzsch et al. | 454/64 |
| 5,162,017 | 11/1992 | Nordin | 454/63 |

FOREIGN PATENT DOCUMENTS

| | | |
|---|---|---|
| 418932 | 7/1981 | Sweden . |
| 423136 | 4/1982 | Sweden . |
| 2172386 | 9/1986 | United Kingdom . |

*Primary Examiner*—Harold Joyce

*Attorney, Agent, or Firm*—Tarolli, Sundheim, Covell, Tummino & Szabo

[57] ABSTRACT

An electric current carrying device at an exhausting device for use in exhausting or sucking-out unhealthy gases, preferably exhausts from vehicles. At least one electric current carrying line (24 and/or 25), extending along a guide rail (4), is included in or forms part of a sealing strip (14 and/or 15).

14 Claims, 5 Drawing Sheets

ELECTRIC CURRENT CARRYING CONDUIT MOUNTED ON SEALING STRIP AT EXHAUSTING DEVICES

The present invention relates to an electric current carrying device at exhausting devices for exhausting or sucking-out unhealthy gases, preferably exhausts from vehicles, whereby the exhausting device includes a guide rail for a travelling crab or carriage, whereby the guide rail includes at least one sealing strip which seals or closes lower portions of said guide rail, whereby the interior of the travelling crab communicates with the interior of the guide rail and is capable of moving away the sealing strip when said crab travels along said guide rail, whereby a gas conduit is provided on the travelling crab for removal of the unhealthy gases, preferably the exhausts from vehicles, through the travelling crab and the guide rail, whereby a device operable by means of electric current and located on the travelling crab and/or on the gas conduit provided thereon is operable through a current circuit including electric current carrying lines which extend along the guide rail and which are connected to a source of current, whereby the current circuit further includes electric current carrying lines which are provided on the travelling crab and which are connected to the device operable by electric current, whereby the electric current carrying lines on the travelling crab through sliding contacts are in electric current transmitting contact with the electric current carrying lines extending along the guide rail and whereby the device operable by electric current is an electromagnetic device for fastening the gas conduit to a vehicle so that exhausts from the exhaust pipe of the vehicle can be sucked thereinto.

Devices of the abovementioned type are already known and can be described as a combination of our U.S. Pat. No. 4,233,889 regarding the guide rail with travelling crab and U.S. Pat. No. 5,162,017 relating to the electromagnetic device for fastening the gas conduit to a vehicle.

At said prior art devices the electric current carrying lines consist of self-supporting profiled rails which are placed beside the guide rails and connected thereto by means of brackets. These profiled rails must be straight for enabling the sliding contacts on the travelling crab to engage said profiled rails when said crab travels along the guide rail. In order to ensure that the profiled rails are sufficiently straight to fulfill the abovementioned object, it is required that said rails are profiled and dimentioned for obtaining the required rigidity, which means that they are expensive. Furthermore, special brackets are required for fastening the profiled rails on the guide rail. The brackets must be isolating against the guide rail and it is an extensive work to mount said brackets. Also, the necessity of these brackets and the mounting thereof are costly factors.

The object of the present invention has been to eliminate these drawbacks and, at first hand, provide an electric current carrying device at a lower price. This is arrived at according to the invention while the device initially defined principally has received the characterizing features of subsequent claim 1. By means of these characterizing features, the electric current carrying device becomes substantially less expensive than previously but also that said device is easier to assemble and transport.

The invention will be further described below with reference to the accompanying drawings, wherein FIG. 1 is a perspective view illustrating an exhausting device having an electric current carrying device according to the invention;

Figure 1:
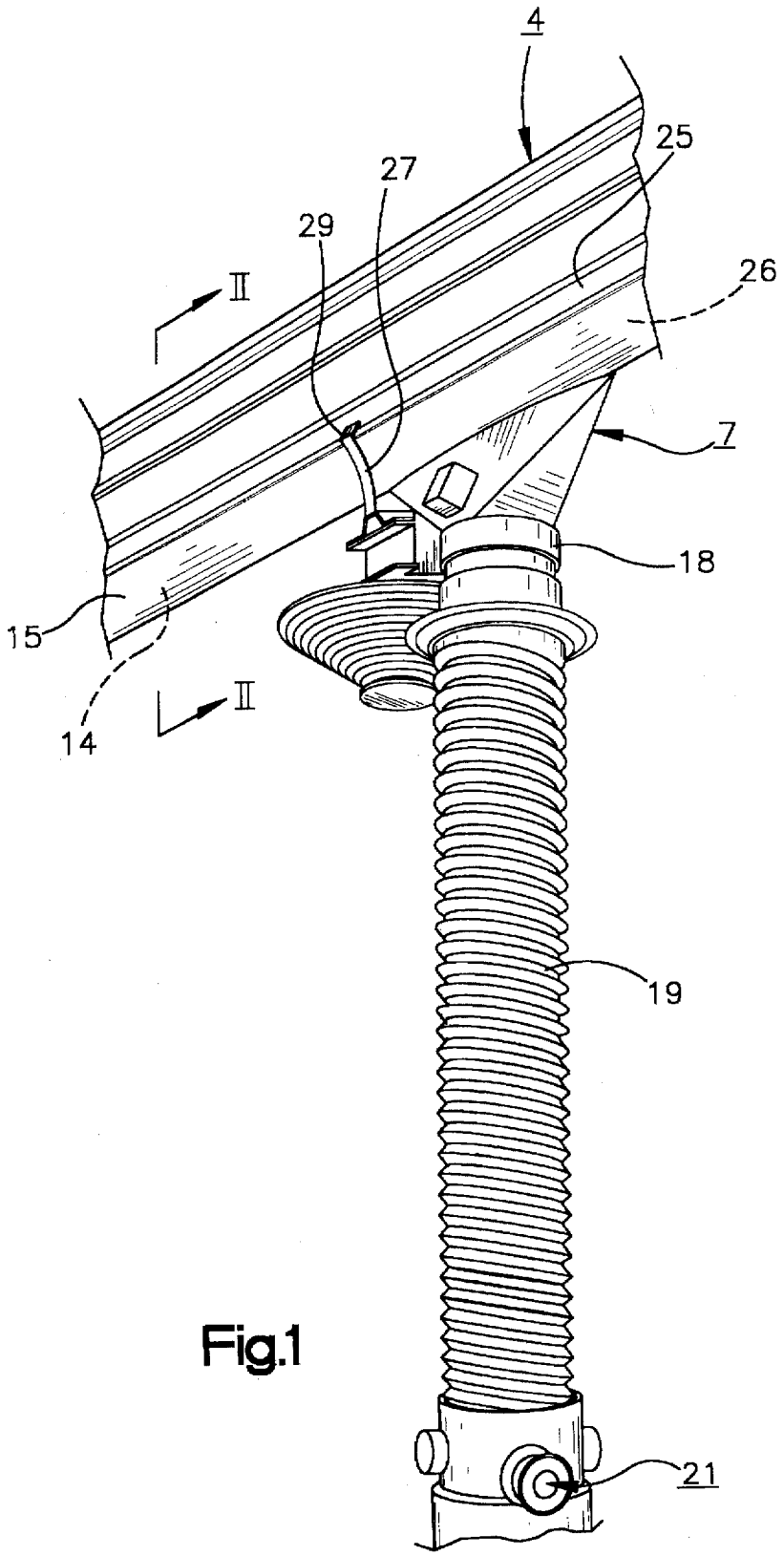
Figure 2:
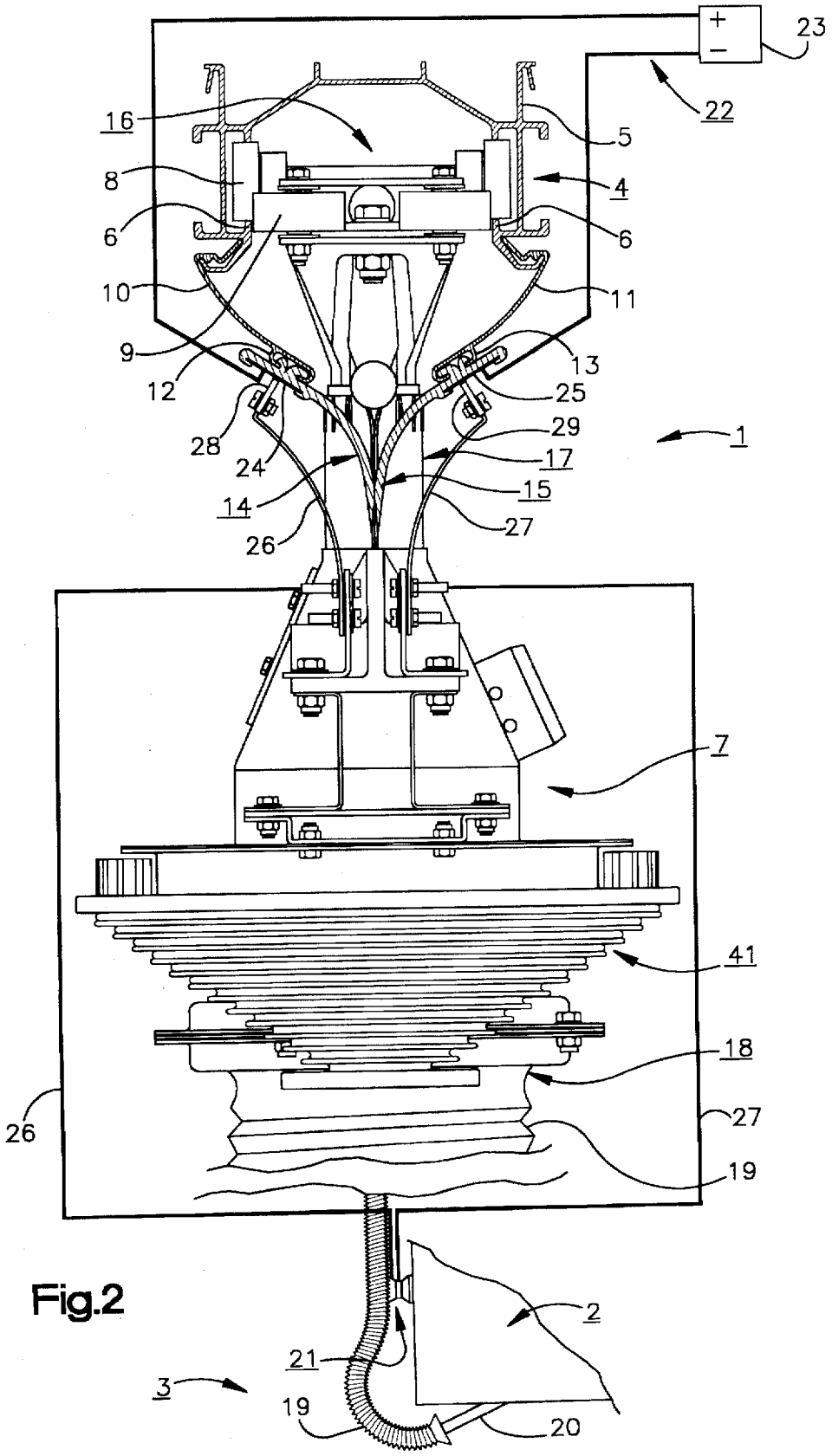
FIG. 2 is a section II—II through the device of FIG. 1.
Figure 3:
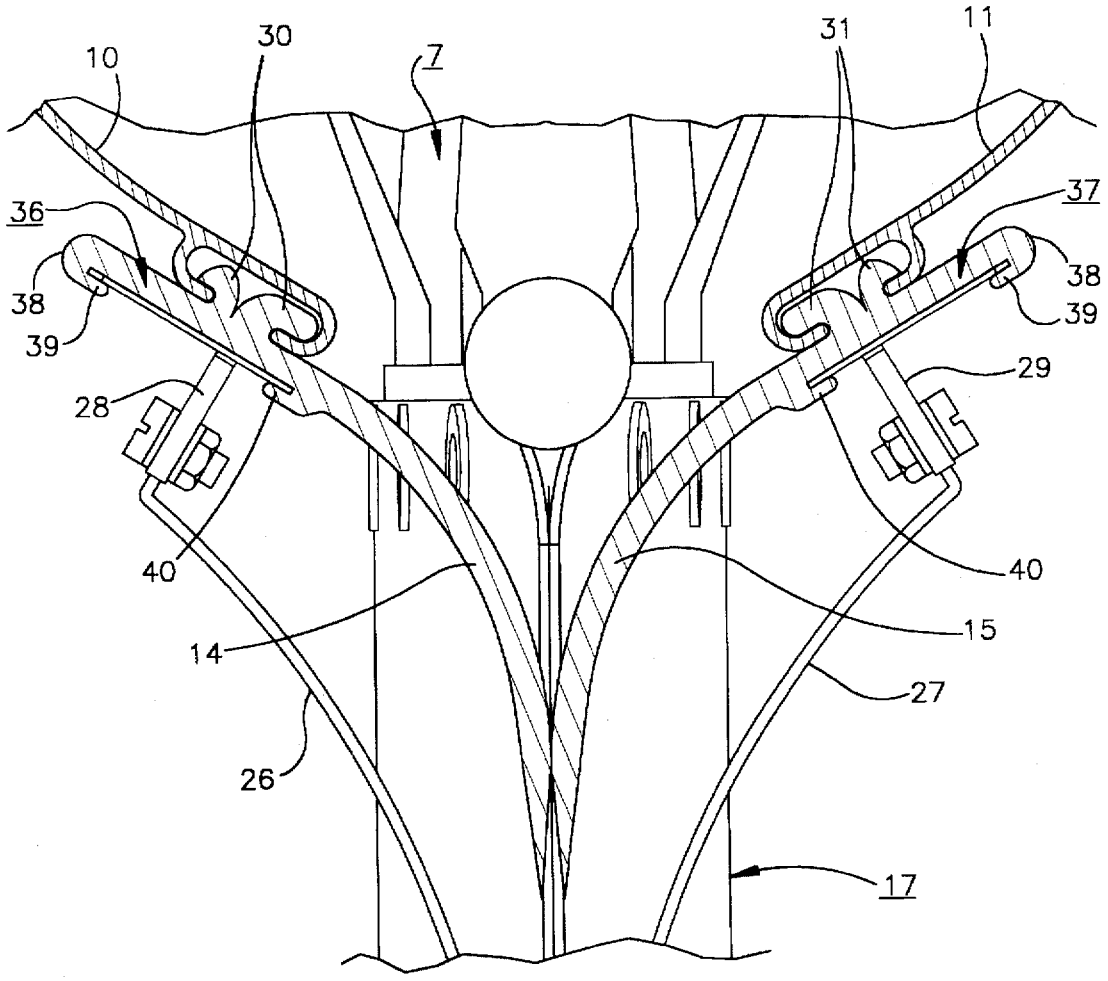
FIG. 3 is a magnification of a portion of the section of FIG. 2.

The drawing figures illustrate an exhausting device 1 for sucking-out or extracting exhausts from vehicles 2 so that said exhausts do not spread in the premises 3 wherein the vehicle 2 is located.

The exhausting device 1 includes a guide rail 4 which through brackets (not shown) is suspended on the ceiling in said premises 3 and which extends along that part of said premises wherein the vehicle 2 is placed and driven. Guide rails 4 for this purpose are wellknown and consist in this case of an elongated upper profile member 5 which defines running flanges 6 adapted to be engaged by wheels 8, 9 on a travelling crab or carriage 7. Down below on the upper profile member 5 there are provided two elongated, downwardly directed profiled strips 10, 11 and each profiled strip 10, 11 is in turn down below provided with a mounting portion 12 and 13 respectively, for a sealing strip 14, 15 with elastic properties. These sealing strips 14, 15 engage each other down below and thereby seal or close lower portions of the guide rail 4, which defines a gas exhausting or extraction passage 16 through which the exhausts from the vehicle 2 are extracted.

The travelling crab 7 has an upper member 17 which from below protrude in between the sealing strips 14, 15 and which can move said sealing strips apart when said crab travels along the guide rail 4. Due to their elastic properties, the sealing strips 14, 15 will again engage each other when the travelling crab 7 has passed.

The travelling crab 7 also includes a lower member 18 from which a gas conduit 19, preferably a hose, is depending. This gas conduit 19 can be connected to the exhaust pipe 20 of the vehicle 2 or located in relation thereto so that it can receive the exhausts from said exhaust pipe 20 for extraction through the gas conduit 19, the travelling crab 7 and the gas extraction passage 16 defined by the guide rail 4.

On the gas conduit 19 there is provided an electromagnetic device 21 which is adapted to be mounted on the vehicle 2 so that said gas conduit 19 holds its extraction position relative to the exhaust pipe 20. The electromagnetic device 21 is operated by electric current through a current circuit 22 which is connected to a source of current 23. The current circuit 22 includes electric current carrying lines 24 and 25 which extend along the guide rail 4 and electric current carrying lines 26 and 27 which are located on the travelling crab 7, extend downwards therefrom along the gas conduit 19 and are connected to the electromagnetic device 21. The electric current carrying lines 26, 27 on the travelling crab 7 are in contact with the lines 24, 25 through sliding contacts 28 and 29, preferably in form of so called carbon-brushes, whereby the current circuit 22 can be closed while the crab 7 travels along the guide rail 4.

The electric current carrying lines 24, 25 which run along the guide rail 4, are mounted on or are included in or form part of the sealing strips 14, 15, whereby the electric current carrying lines 24, 25 are located so that the sealing strips 14, 15 isolate said lines relative to the guide rail 4 with regard to electrical contact. This isolating effect is attained preferably while the electric current carrying lines 24, 25 are provided on such portions of the sealing strips 14, 15 having electric current insulating properties. At these portions of the sealing strips 14, 15, mounting portions 30, 31 can be provided, through which said sealing strips 14, 15 can be mounted on or attached to the mounting portions 12, 13 of the profiled strips 10, 11. Hereby, the electric current carrying lines 24, 25 will be located on such upper portions of the sealing strips 14, 15 which are not moved away by the crab or carriage 7 during its travel along the guide rail 4, but alternatively, said electric current carrying lines 24, 25 can be mounted on or form part of such portions of the sealing strips 14, 15 which are moved away by the travelling crab 7, provided said lines 24, 25 are flexible.

Each electric current carrying line 24 and 25 respectively, includes or consists of preferably a tape 32 of metallic material, e.g. stainless spring steel.

Figure 4:
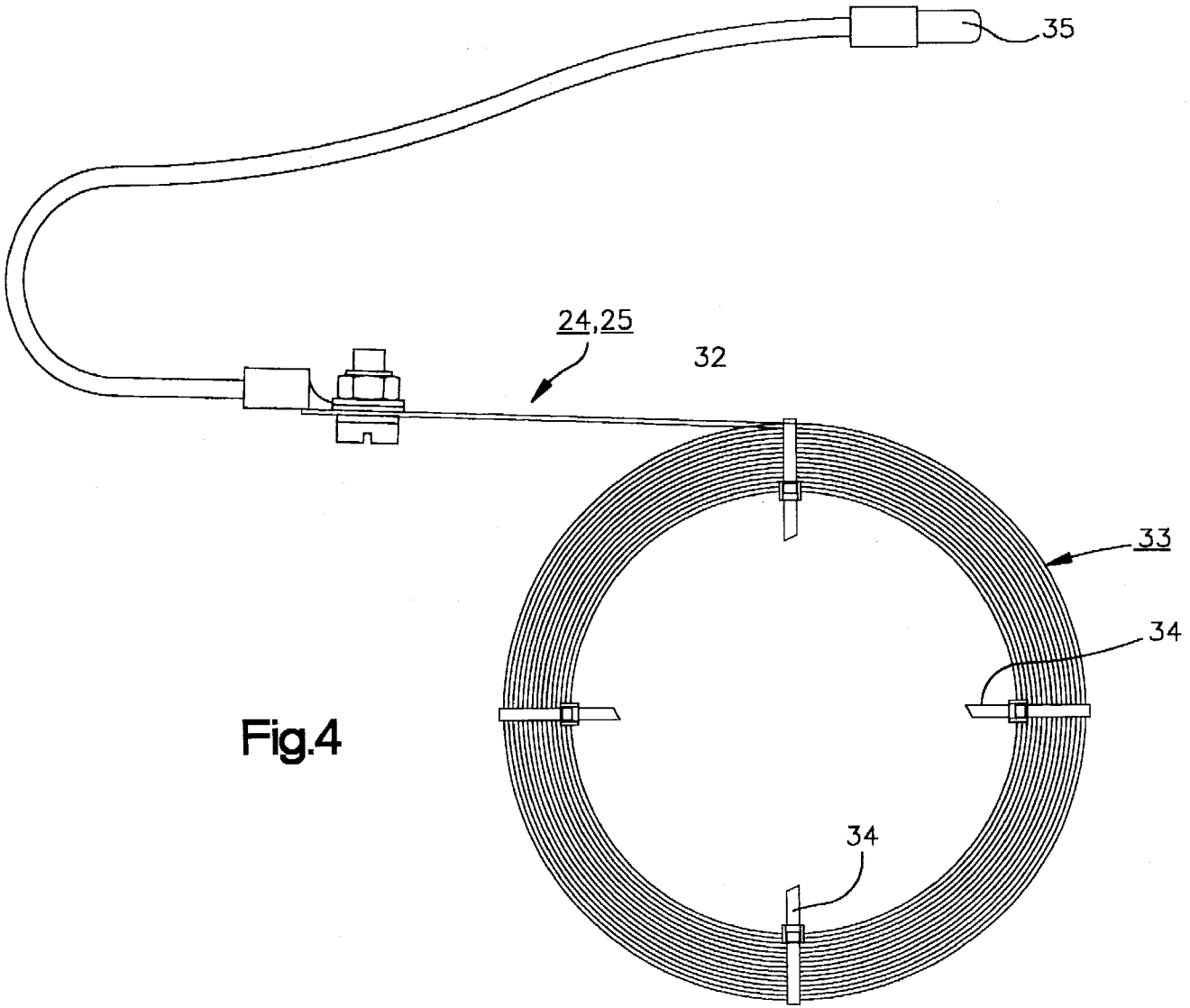
FIG. 4 is a plan view of a coiled up metal tape forming part of the electric current carrying device of FIG. 1.
Figure 5:
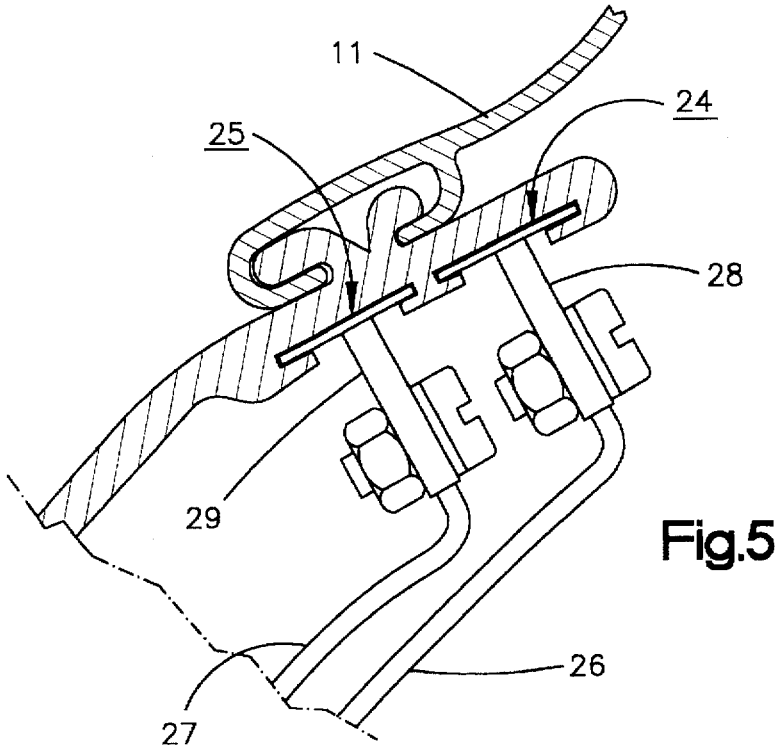
FIG. 5 is a sectional view of parts of the device of FIG. 1 with an electric current device of alternative construction.
Figure 6:
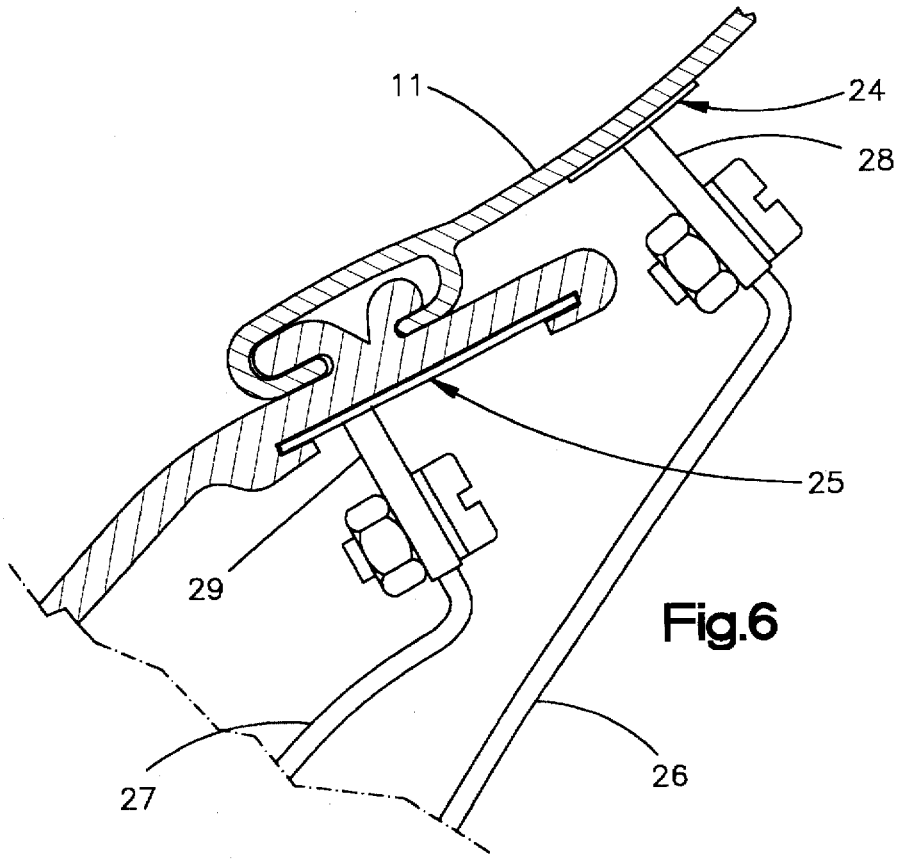
FIG. 6 is a sectional view of parts of the device of FIG. 1 with an electric current device of another alternative construction.

The tape 32 preferably has a rectangular cross-sectional shape and said tape has a thickness of preferably about 0,5 mm and a width of preferably about 32 mm. This tape 32 can be coiled up to a roll 33 (see FIG. 4) which is held together by means of any suitable type of clamping means 34. One end portion of the tape 32 has a connector 35 for connection to an electric current line forming part of the current circuit 22 and adapted to connect said tape 32 to the source of current 23. The tape 32 may be transported in coiled up condition and when it shall be mounted at the sealing strip 14 and 15 respectively, the clamping means 34 are released and said tape uncoiled so that it can be inserted into a groove 36 and 37 respectively, provided therefore in each sealing strip 14 and 15 respectively.

Each groove 36 and 37 respectively, is provided on the opposite side of the sealing strip 14 and 15 respectively, as the mounting portions 30, 31 of said strip, and adjacent one longitudinal edge 38 of said strip 14 and 15 respectively and right opposite to or substantially opposite to said mounting portions 30, 31. Each groove 36 and 37 respectively, is defined by two elastic tongues 39, 40 which are provided so that one tongue 39 extends over a longitudinal edge portion of the electric current carrying line 24 and 25 respectively, and the other tongue 40 over an opposed edge portion of said lines 24 and 25 respectively.

The tongues 39, 40 are preferably integral with the sealing strip 14 and 15 respectively, and since each sealing strip preferably entirely consists of elastic rubber material, the tongues 39, 40 are also elastic. The electric current carrying lines 24 and 25 respectively, can preferably be mounted on the respective sealing strip 14, 15 by first inserting one edge portion thereof in under one of the tongues 39, 40, whereafter the other tongue 39, 40 is folded back so that the electric current carrying line 24 and 25 respectively, can be inserted into the groove 36 and 37 respectively, in its entire width. Thereafter, the tongue 39 or 40 which is folded back is released so that said tongue, due to its elasticity, returns to its original position, whereby the tongues 39, 40 together retain the electric current carrying line 24 and 25 respectively.

Those portions 36, 37, 39, 40 of the sealing strips 14, 15 on which the electric current carrying lines 24, 25 are mounted, are preferably identical or substantially identical in shape and also both the electric current carrying lines 24, 25 in the two sealing strips 14, 15 are preferably identical or substantially identical in shape.

When the current circuit 22 is closed, the electromagnetic device 21 is activated, whereby said device can be fastened or mounted on such a suitable spot on the vehicle 2 that the gas conduit 19 can be moved or brought to an operating position relative to the exhaust pipe 20. When the current circuit 22 is opened, the magnetic force of the electromagnetic device 21 is disrupted, whereby said device loosens from the vehicle 2 which now can leave the premises 3 without bringing the gas conduit 19 with it. The gas conduit 19 is preferably pulled up by means of a winding device 41 located on the travelling crab 7.

The present invention is not limited to the embodiment illustrated in the drawings and described in the specification. As examples of alternative embodiments of the invention it should be mentioned that it can be adapted to carry electric current to another device operated by electric current than an electromagnetic device 21, e.g. for operating a driving motor for driving the travelling crab 7 or for operating a signalling device; the device operable by electric current can be located in another position than shown, e.g. on the travelling crab 7; two electric current carrying lines 24, 25 can be included in one and same sealing strip 14 or 15 irrespective of whether there is only one sealing strip 14 or 15 for closing the guide rail 4 or there are two sealing strips 14, 15 which together seal or close the guide rail 4; one electric current carrying line 24 or 25 can form part of a sealing strip 14 or 15 while the other line 25 or 24 is a current carrying member or part of the guide rail 4; the electric current carrying lines 24 and/or 25 may have another shape and/or be of another material than what is described above and shown in the drawings.

I claim:

1. Electric current carrying device at exhausting devices for exhausting or sucking-out unhealthy gases from vehicles, whereby the exhausting device (1) includes a guide rail (4) for a travelling crab (7), whereby the guide rail (4) includes at least one sealing strip (14 and/or 15) which seals or closes lower portions of said guide rail (4), whereby the interior of the travelling crab (7) communicates with the interior of the guide rail (4), whereby a gas conduit (19) is provided on the traveling crab (7) for removal of the unhealthy gases from vehicles, through the travelling crab (7) and the guide rail (4), whereby a device (21) operable by means of electric current and located on the travelling crab (7) and/or on the gas conduit (19) provided thereon is operable through a current circuit (22) including electric current carrying lines (24, 25) which extend along the guide rail (4) and which are connected to a source (23) of current, whereby the current circuit (22) further includes electric current carrying lines (26, 27) which are provided on the travelling crab (7) and which are connected to the device (21) operable by electric current, whereby the electric current carrying lines (26, 27) on the travelling crab (7) through sliding contacts (28, 29) are in electric current transmitting contact with the electric current carrying lines (24, 25) extending along the guide rail (4), and whereby the device (21) operable by electric current is an electromagnetic device for fastening the gas conduit (19) to a vehicle (2) so that exhausts from the exhaust pipe (20) of the vehicle (2) can be sucked thereinto, characterized in that at least one of the electric current carrying lines (24 and/or 25) running along the guide rail (4) is provided on or is included in or form part of the sealing strip (14 and/or 15).

2. Electric current carrying device according to claim 1, characterized in that the electric current carrying line (24 and/or 25) is mounted on the sealing strip (14 and/or 15) so that said sealing strip (14 and/or 15) insulates said electric current carrying line (24 and/or 25) relative to the guide rail (4) with regard to electrical contact.

3. Electric current carrying device according to claim 2, characterized in that the electric current carrying line (24 and/or 25) is mounted on a part of the sealing strip (14 and/or 15) having current insulating properties.

4. Electric current carrying device according to claim 1, characterized in that the electric current carrying line (24 and/or 25) is mounted at such mounting portions (30 and/or 31) of the sealing strip (14 and/or 15) through which said strip (14 and/or 15) is fastened or attached to the guide rail (4).

5. Electric current carrying device according to claim 1, whereby the sealing strip (14 and 15 respectively) on one side adjacent a longitudinal edge (38) is provided with protruding mounting portions (30 and/or 31) through which said strip is attached to the guide rail (4), characterized in that the electric current carrying line (24 and/or 25) is provided on the opposite side of the sealing strip (14 and/or 15) right opposite to or substantially opposite to the protruding mounting portions (30 and/or 31).

6. Electric current carrying device according to claim 5, characterized in that the electric current carrying line (24 and/or 25) is mounted in a groove (36 and/or 37) in said opposite side of the sealing strip (14 and/or 15) and that the groove (36 and/or 37) is defined by two tongues (39, 40) protruding from said opposite side of the sealing strip, whereby one tongue (39) extends over a longitudinal edge portion of the electric current carrying line (24 and/or 25) and whereby the other tongue (40) extends over an opposing edge portion of said electric current carrying line (24 and/or 25).

7. Electric current carrying device according to claim 6, characterized in that at least one tongue (39 and/or 40) is elastic and that the electric current carrying line (24 and/or 25) can be mounted at the sealing strip (14 and/or 15) by insertion into the groove (36 and/or 37) in such manner that one longitudinal edge portion of said electric current carrying line (24 and/or 25) is moved in under one of the tongues (39 and/or 40) whereafter the other tongue (40 and/or 39) is folded away so that the electric current carrying line (24 and/or 25) can be inserted into the groove (36 and/or 37) in its entire width, whereafter the tongue (39 or 40) folded away is released such that it, due to its elasticity, returns to its original position so that both tongues (39, 40) retain the electric current carrying line (24 and/or 25).

8. Electric current carrying device according to claim 1, characterized in that the electric current carrying line (24 and/or 25) consists of a tape (32) of metallic material comprising stainless spring steel.

9. Electric current carrying device according to claim 8, characterized in that the tape (32) is capable of being coiled up or wound upon a roll (33) which is capable of being unwound when said tape (32) is to be mounted on the sealing strip (14 and/or 15) and that the tape (32) at one end portion has a connector (35) through which said tape can be connected to an electric current line which is adapted to connect the tape (32) to the source (35) of current.

10. Electric current carrying device according to claim 9, characterized in that the tape (32) has a rectangular cross-sectional shape, whereby the thickness of said tape (32) preferably is about 0.5 mm and its width preferably about 32 mm.

11. Electric current carrying device according to claim 1, whereby the guide rail (4) has two sealing strips (14, 15) which together seal or close lower portions of said guide rail (4), characterized in that one of the electric current carrying lines (24 or 25) which extend along the guide rail (4) is mounted on or is included in or form part of one of the sealing strips (14 or 15) and that the other of the electric current carrying lines (25 or 24) extending along the guide rail (4) is provided on or is included in or form part of the other sealing strip (15 or 14).

12. Electric current carrying device according to claim 11, characterized in that those portions (36, 37, 39, 40) of both the sealing strips (14, 15) on which the electric current carrying lines (24, 25) are provided or in which said lines are included or form part of, are identical or substantially identical and that the electric current carrying lines (24, 25) mounted on both the sealing strips (14, 15) or included therein or forming part thereof, are identical or substantially identical.

13. Electric current carrying device according to claim 1, characterized in that two electric current carrying lines (24, 25) are provided on or are included in or form part of the one and same sealing strip (14 or 15).

14. Electric current carrying device according to claim 1, characterized in that one electric current carrying line (24 or 25) is provided on or is included in or form part of a sealing strip (14 or 15) while another electric current carrying line constitutes an electric current carrying portion or member of the guide rail (4).

* * * * *